US007640941B2

(12) United States Patent
Watters et al.

(10) Patent No.: US 7,640,941 B2
(45) Date of Patent: Jan. 5, 2010

(54) BRUSH AND ROLLER CLEANER

(75) Inventors: Robert D. Watters, Ottawa (CA); Romeo Graham, Chelsea (CA); Joseph Luc Boucher, Ottawa (CA); Michael G. Sirois, Ottawa (CA); Tracine Andrus, Baltimore, MD (US)

(73) Assignee: Black & Decker, Inc., Townson, MD (US)

( * ) Notice: Subject to any disclaimer, the term of this patent is extended or adjusted under 35 U.S.C. 154(b) by 696 days.

(21) Appl. No.: 11/385,693

(22) Filed: Mar. 22, 2006

(65) Prior Publication Data

US 2007/0221260 A1 Sep. 27, 2007

(51) Int. Cl.
*B08B 3/00* (2006.01)

(52) U.S. Cl. ..... 134/138; 134/198; 134/900; 68/213

(58) Field of Classification Search ..... 134/138, 134/900; 68/213
See application file for complete search history.

(56) References Cited

U.S. PATENT DOCUMENTS

| | | | | |
|---|---|---|---|---|
| 2,239,741 | A | 4/1941 | Schroder | |
| 2,726,011 | A * | 12/1955 | Young | 220/736 |
| 2,794,265 | A | 6/1957 | Kruger | |
| 2,826,826 | A | 3/1958 | Boehm | |
| 2,902,773 | A | 9/1959 | Dudek | |
| 2,965,111 | A | 12/1960 | Feigelman | |
| 3,075,534 | A | 1/1963 | Habostad | |
| 3,696,457 | A | 10/1972 | Hand | |
| 3,927,539 | A | 12/1975 | Harkison | |
| 4,003,835 | A | 1/1977 | Johnson | |
| 4,446,590 | A | 5/1984 | Kirchner, Jr. et al. | |
| 4,501,314 | A | 2/1985 | Wakabayashi et al. | |
| 4,641,673 | A | 2/1987 | Conley et al. | |
| 4,976,031 | A | 12/1990 | Miller | |
| 5,095,928 | A * | 3/1992 | Phipps | 134/138 |
| 5,184,637 | A | 2/1993 | Kowis | |
| 5,184,775 | A | 2/1993 | Kerber | |
| 5,221,297 | A | 6/1993 | Childress et al. | |
| 5,402,808 | A * | 4/1995 | Wallis et al. | 134/104.2 |
| 5,499,767 | A | 3/1996 | Morand | |
| 5,561,921 | A * | 10/1996 | Vanderlinden | 37/227 |

(Continued)

FOREIGN PATENT DOCUMENTS

EP 0879553 A2 11/1998

(Continued)

*Primary Examiner*—Michael Barr
*Assistant Examiner*—Jason Y Ko
(74) *Attorney, Agent, or Firm*—Kramer & Amado, PC

(57) ABSTRACT

A brush and roller cleaner includes a hollow canister to receive a spray wand. A control knob pivots with respect to the canister to direct pressurized liquid from apertures of the spray wand. A top cap assembly mates with the canister in one of two positions, 180 degrees offset from one another. The top cap assembly has a tool holding assembly that is capable of holding a paint tool or roller. The tool holding assembly rotates in response to the liquid output from the spray wand apertures. The top cap assembly is capable of holding a roller in a first or second position. The roller rotates within the canister in response to the liquid output from the spray wand apertures to clean the roller cover. A handle for the cleaner supports a roller frame clip for holding the roller in a first or second position.

36 Claims, 6 Drawing Sheets

U.S. PATENT DOCUMENTS 5,785,590 A 7/1998 Tsuchida
5,809,653 A 9/1998 Everts
6,019,111 A 2/2000 Gillies
6,038,787 A * 3/2000 Dean et al. ..... 34/312
6,116,255 A * 9/2000 Walter ..... 134/138
6,802,464 B2 10/2004 Marconnet
2002/0074024 A1 * 6/2002 Schwartz ..... 134/34
2002/0190404 A1 12/2002 Baarda
2004/0003835 A1 1/2004 Higgins

FOREIGN PATENT DOCUMENTS

GB 2266682 11/1993

* cited by examiner

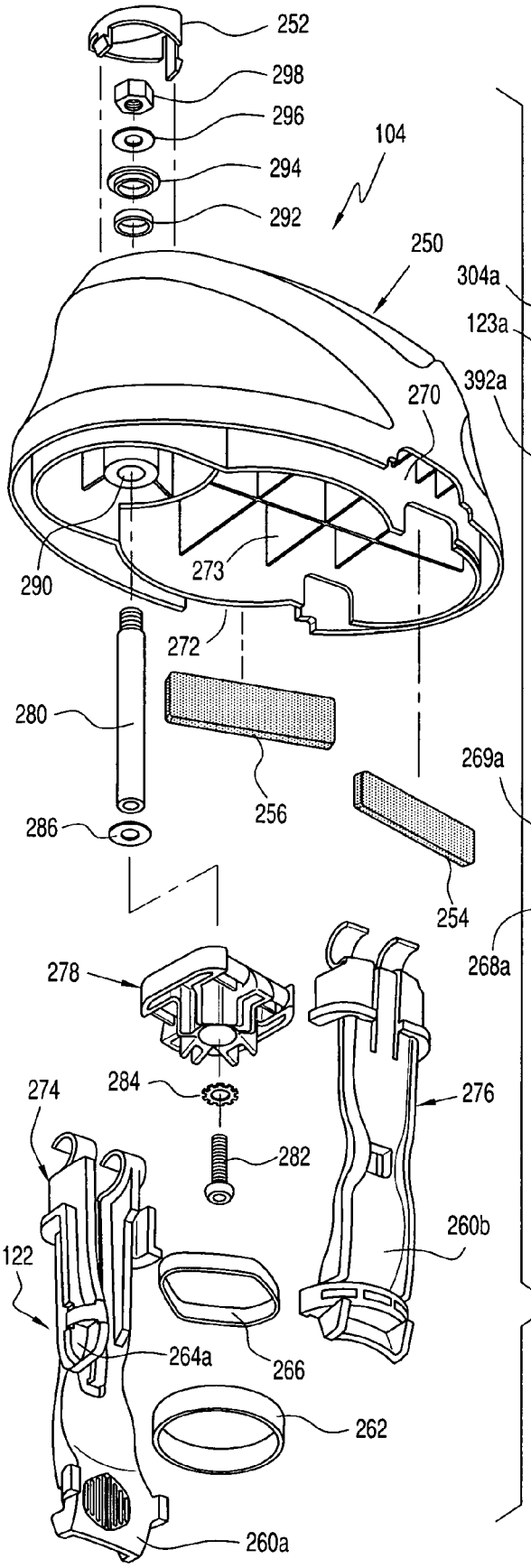
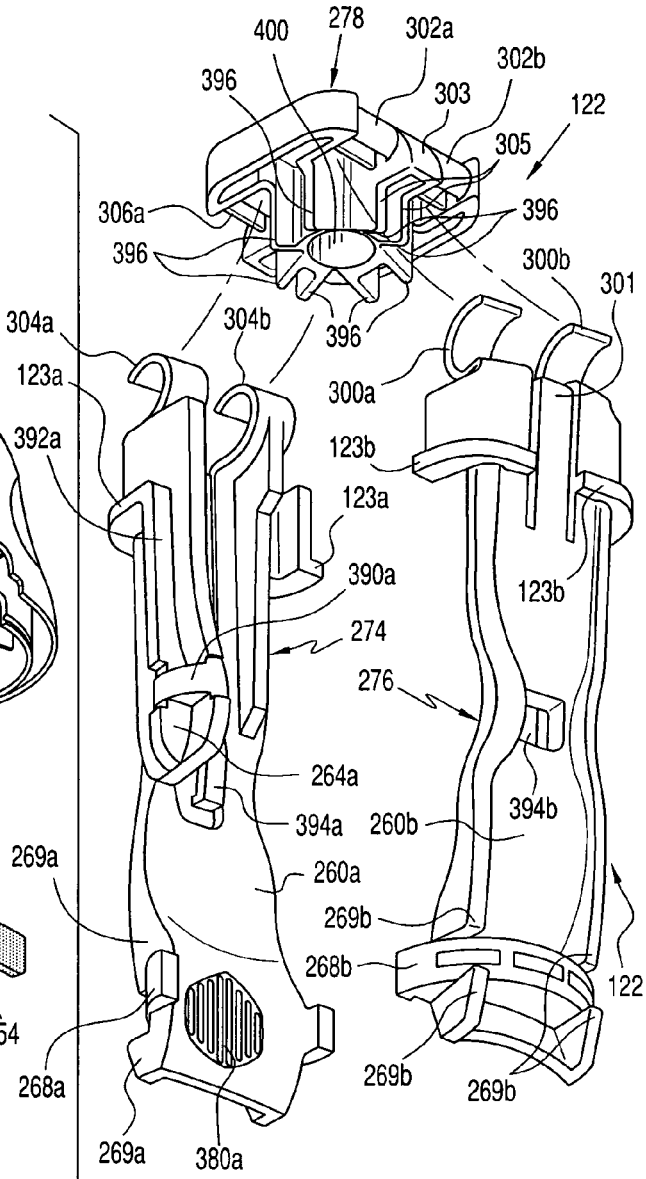
FIG. 10
FIG. 9

106
111
344
356
350
354
351
346
353
352
368
340
341
342
364
366
110
360
362
112
363
124
365
125
369
372
410
114

BRUSH AND ROLLER CLEANER

FIELD OF THE INVENTION

The present invention generally relates to painting tool cleaners. More particularly, the present invention relates to brush and roller cleaners that operate under the power of water pressure supplied from a household water supply.

BACKGROUND OF THE INVENTION

Paint is a general term for a family of products used to protect and/or add color to an object or surface by way of a pigmented or non-pigmented coating. Paint is very common and is applied to almost every kind of object. In particular, paint is regularly provided to a variety of interior household painting surfaces such as walls, ceilings, trim surfaces, and flooring, as well as exterior surfaces such as siding, clapboards, and decking. Paint is also regularly applied by professionals and lesser experienced individuals to a variety of consumer and non-consumer articles.

Paint is generally formed from three components: binder, diluent and additives. The binder eventually solidifies to form a dried paint film. The diluent is volatile and serves to adjust the viscosity of the paint, but does not become part of the dried paint film. Other components found in paint, such as pigments, are generally known as additives. A single paint component may serve dual purposes, such as both binder and pigment. Typical binders include synthetic or natural resins such as acrylics, polyurethanes, polyesters, melamines, oils, or latex. Likewise typical diluents include organic solvents such as alcohols, ketones, esters, glycol ethers, and the like. Water is a common diluent. Various additives that are included within a paint mixture include pigments, dyes, catalysts, thickeners, stabilizers, emulsifiers, texturizers, adhesion promotors, flatteners (de-glossing agents), and the like. After application, the paint solidifies and becomes tack-free.

Paint may impregnate or partially impregnate a surface. As set forth herein, paint includes the general paint mixtures set forth above, as well as other surface coatings such as stains, varnishes, lacquers, dyes, colored glues, oils, waxes, shellacs, glazes, inks, and finishes. Further, as set forth herein, paint may be virtually pigment free, and may be used as a clear protective finish or general protectant.

Traditional manual painting tools include handled application tools, such as brushes, sponges, blades and the like. Handled application tools are available in various sizes and shapes. Paint brushes traditionally have a plurality of bristles permanently attached to a rigid or semi-rigid handle. The bristles may be formed from a natural material that is partially absorbent, such as horse hair. The bristles may also be formed from a synthetic material, such as nylon, which is not partially absorbent. The number of bristles generally determines the amount of paint that may be transferred with each application or painting stroke. Likewise, the size the associated brush handle is generally, but not necessarily, determined by the number of bristles. Paint brushes are generally cleaned and reused after use. Natural bristle paint brushes, especially higher-quality horse hair brushes, are generally cleaned and hung by the handle so that the bristles dry in a uniform, generally straight, elongated shape.

Rollers are manual painting tools for applying paint or similar liquid substances, and generally include a cylindrical pad, also known as a roller cover, which is removably attached to a rotatable roller cage and a roller frame. Paint rollers are generally 9" to 9.5" in width, however smaller rollers, also known as brayers, are generally used for decorative or trim painting. The roller cage is generally convex toward the center to hold the roller cover thereon. The cage generally rotates about an angular wire shaft (also known as a roller frame) by way of a bearing, and a handle is attached to the wire shaft. As the roller cover is manually engaged with a painting surface, friction contact induces the cage to rotate, and thereby apply a layer of paint. The roller cover thickness is called a "nap," which varies in thickness for the particular application. For example, a ¼" nap applies a thinner layer of paint and is generally used for flat surfaces. A ⅜" nap or 1" nap applies a thicker layer of paint, and is generally suitable for covering surface irregularities, or rougher surfaces, such as concrete blocks or stucco walls. The nap may also include a pattern to provide a decorative design. The nap may be formed from a partially absorbent material, such as wool, or a non-absorbent material, such as rubber or nylon. The roller cover is generally cleaned during use, such as when switching colors or when taking a break from painting. The roller cover is also cleaned to reduce the amount of mess before manual removal from the roller cage. The roller cover may also be completely removed from the roller cage for cleaning.

Accordingly, there remains a need for a painting tool cleaner that may easily and expeditiously remove paint from a paint tool. There also remains a need for a painting tool cleaner that may be powered by a household water supply to agitate and remove paint from the tool.

SUMMARY OF THE INVENTION

In one preferred form, the present invention provides a tool cleaner including a hollow canister, a spray wand assembly, and a top cap assembly. The hollow canister has a top surface defining an opening to receive the top cap assembly, and has an open bottom for expelling liquid and paint from the canister. The spray wand assembly has a spray wand with a plurality of apertures that output a liquid stream when connected to a pressurized liquid supply. The spray wand is disposed within the canister and is manually pivotable by a control knob that is disposed above the canister. The top cap assembly mates with the top opening of the canister to hold a paint tool in a first or second position.

In another preferred form, the present invention provides a tool cleaner including a hollow canister, a spray wand assembly, and a top cap assembly. The spray wand assembly has a pivotable spray wand with a plurality of apertures that output a liquid stream when connected to a pressurized liquid supply, such as a conventional household water supply. The top cap assembly has a resiliently closable tool holder assembly to rotatably retain a handled application tool. The tool holder assembly includes a pair of tool holding sections that are pivotally urged toward each other with a first elastic tension member. Each of the tool holding members has a first tool holding arm. The tool holding arms cooperate with each other to retain the handled application tool. Each of the tool holding sections also has a second tool holding arm. The second tool holding arms also cooperate to retain the handled application tool. A second elastic tension member is disposed about an outer periphery of the second tool holding arms.

In another preferred form, the present invention provides a tool cleaner having a hollow canister, a spray wand assembly and a top cap assembly. The spray wand assembly has a spray wand with a plurality of staggered apertures. The apertures are staggered with respect to a center line of frontal section of the spray wand such that at least one of the apertures is disposed on a first side of the center line and at least one of the apertures is disposed on the center line or on a second side of the center line. At least one of the apertures is a fan jet that outputs a liquid stream fanning in the longitudinal direction with respect to the spray wand with a greater dispersion angle than in the perpendicular direction.

Further areas of applicability of the present invention will become apparent from the detailed description provided hereinafter. It should be understood that the detailed description and specific examples, while indicating the preferred embodiments and best mode of the invention, are intended for purposes of illustration only and are not intended to limit the scope of the invention.

BRIEF DESCRIPTION OF THE DRAWINGS

Additional advantages and features of the present invention will become apparent from the subsequent description and the appended claims, taken in conjunction with the accompanying drawings, wherein:

FIG. 9 is an exploded perspective view of the top cap assembly of FIG. 8;

FIG. 10 is an exploded perspective view of a tool holder assembly;

DETAILED DESCRIPTION OF THE PREFERRED EMBODIMENTS

Figure 1:
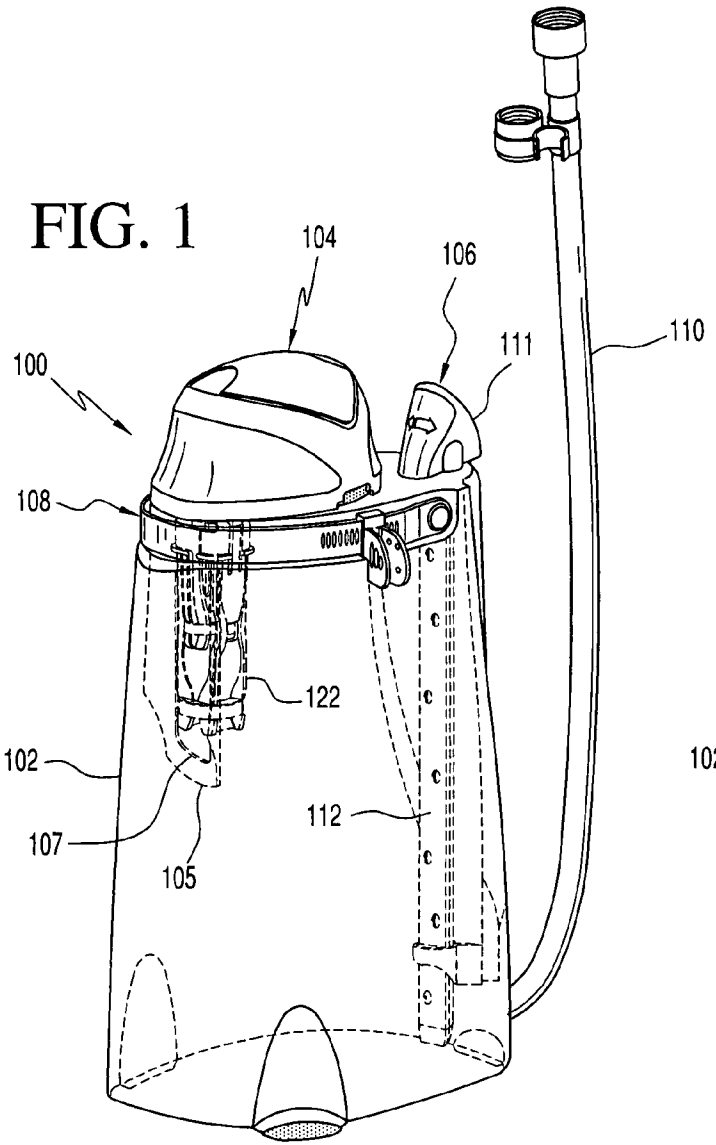
FIG. 1 is a perspective view of a tool cleaner according to an embodiment of the present invention.

With reference now to the figures, and in particular FIG. 1, a preferred embodiment of a tool cleaner 100 is illustrated in accordance with the teachings of the present invention. In particular the tool cleaner 100 is illustrated to include canister 102, to which a top cap assembly 104, spray wand assembly 106 and handle assembly 108 are connected. The top cap assembly 104 is removably and reversibly engaged with the top of canister 102, and is configured to secure a handled application tool or roller. Spray wand assembly 106 includes supply hose 110, control knob 111 and spray wand 112. When supply hose 110 is attached to a household water supply, streams of liquid water are directed outward from spray wand 112 to thereby clean the enclosed tool or roller. Control knob 111 is connected to a top portion of spray wand 112 and manually pivots to laterally direct the liquid streams of water across the enclosed tool or roller. As further illustrated in FIGS. 2 and 3, the control knob 111 may sequentially pivot in a back and forth manner, i.e. pendulate, under control of an operator to thereby direct pressurized liquid streams 114 from the plurality of apertures 124, 125 toward the roller or handled application tool held within the tool cleaner 100. The force of the liquid streams hitting the tool or roller induces rotation, which thereby assists with cleaning. Canister 102 is generally frusto-conical in shape such that the base diameter is greater than the top diameter. The bottom of canister 102 is open to facilitate egress of liquid and removed paint through the bottom thereof.

The top cap assembly 104 sits onto canister 102 in one of two positions, 180 degrees offset from one another. FIG. 1 illustrates top cap assembly 104 in a first position for cleaning a roller (not shown). This is also known as roller cleaning mode. Thin rib 105 is integrally formed with canister 102 and includes an interior ridge 107 that is positioned towards the front of canister 102. If top cap assembly has a brush loaded into tool holder assembly 122 or if a roller cover is loaded around tool holder assembly 122, the thin rib 105 resists insertion into canister 102. According to a preferred embodiment, thin rib 105 actually prevents insertion of a loaded tool holder assembly 122 when the top cap assembly 104 is positioned according to FIG. 1. The user is then reminded to flip top cap assembly 180 degrees (see position of FIG. 2), thereby placing the loaded tool holder assembly 122 closer to spray wand 112. The illustrated position of top cap assembly 104 is the same as FIG. 3 for cleaning a roller cover that is still attached to a roller frame. According to embodiments of the present invention, canister 102 may be opaque, translucent, or transparent. According to a preferred embodiment, canister 102 is translucent so that a user may visually inspect the tool or roller during cleaning.

Figure 2:
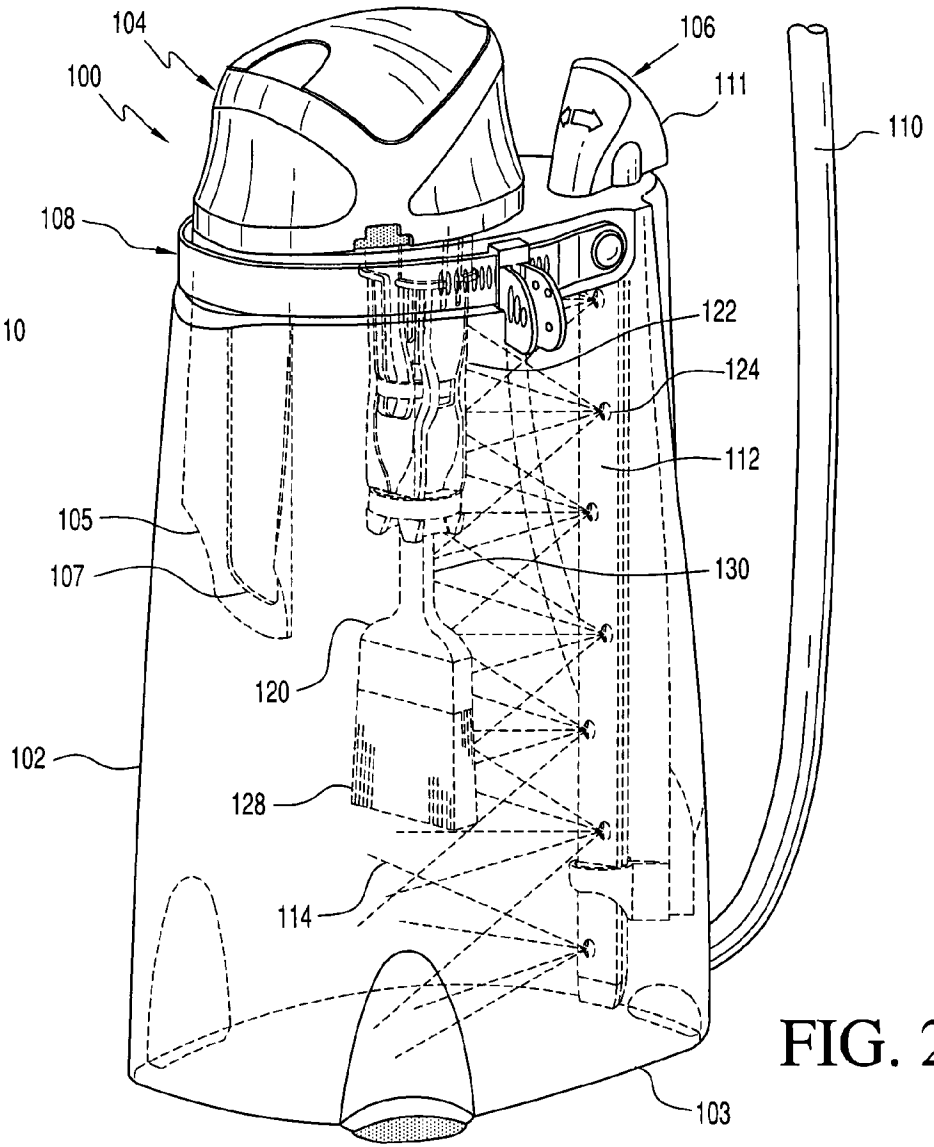
FIG. 2 is a perspective view of the tool cleaner of FIG. 1 illustrating cleaning of a handled application tool in the form of a brush.

FIG. 2 is a perspective view of the tool cleaner 100 illustrating cleaning of a handled application tool 120 in the form of a brush. Tool 120 is releasably held within canister 102 by way of tool holder assembly 122, described in greater detail below. Tool holder assembly 122 is rotationally connected to top cap assembly 104 and freely rotates within canister 102. Tool holder assembly 122 provides a dual purpose. First, a plurality of pivotal arms (described in greater detail below) is configured to releasably hold a tool, such as a paint brush there between. Second, a soiled roller cover may be removed from a roller frame and disposed about the outer periphery of tool holder assembly 122 for cleaning. Streams of liquid are output from a plurality of apertures 124 within spray wand 112. According to a preferred embodiment, and described in greater detail below, apertures 124 are fan jets that produce liquid streams that radiate at an angle with respect to the longitudinal axis of spray wand 112. The fan jets streams are also narrow in the perpendicular direction to spray wand 112, and thereby have a fan-like shape.

During operation, the liquid streams 114 output from spray wand 112 penetrate the paint holding material 128 in handled application tool 120. In the illustrated embodiment, tool 120 is a brush and paint holding material 128 is a plurality of bristles. Likewise, the liquid streams 114 direct paint off from non-paint holding surfaces, such as handle 130. The resulting liquid mixture then exits through the open bottom 103 of canister 102. If the tool 120 directly faces or is angularly perpendicular to the spray wand 112, no rotation in tool 120 will be produced. However, if the user manually rotates control knob 111 away from the center of tool 120, rotation will be induced, thereby assisting in separation of paint from the tool. The speed of rotation is generally proportional to the distance of liquid streams 114 from the center of tool 120. Accordingly, a faster rotation is produced and greater paint separation is achieved as the water streams are directed towards the edges of tool 120. Additional separation may be achieved as the user manually rotates the direction of the water streams against the direction of tool rotation by way of control knob 111.

According to an alternate embodiment, hose 110 is connected to a pressurized water supply to thereby provide a greater liquid force from spray wand 112. According to another alternate embodiment, the liquid supplied to tool cleaner 100 by way of supply hose 110 is a combination of liquid, such as water, and a paint removing agent, such as detergent or paint thinner. According to another alternate embodiment, the bottom of canister 102 is closed such that a roller or handled application tool may soak in the liquid within canister 102. The liquid may be water, paint thinner, or a combination of water and an additive such as detergent.

Figures 3, 4, 5A, 5B:
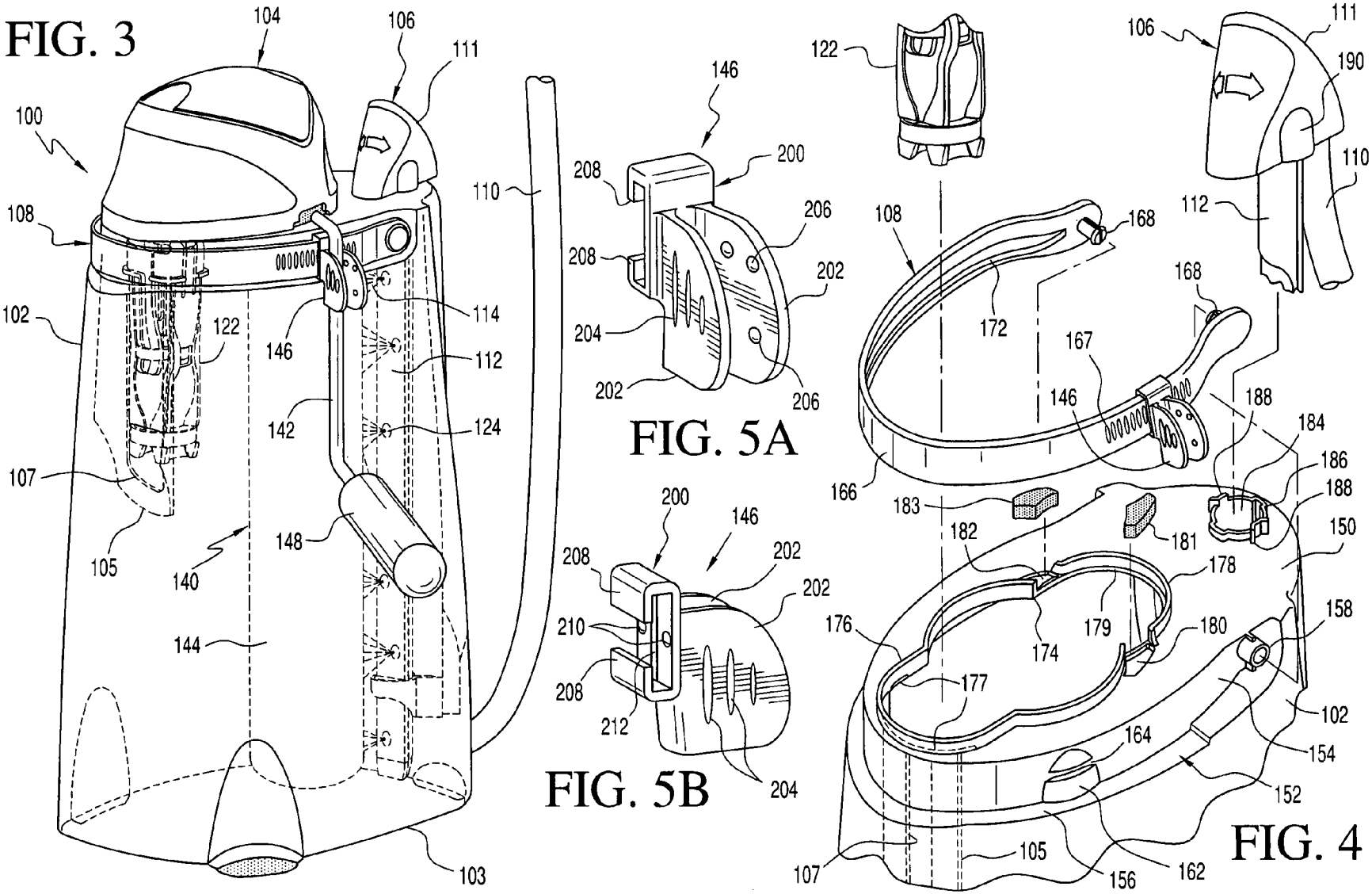
FIG. 3 is a perspective view of the tool cleaner of FIG. 1 illustrating cleaning of a roller.
FIG. 4 is an exploded perspective view of the top of the tool cleaner illustrating connection of a spray wand assembly and handle assembly.
FIG. 5A is an elevated perspective view of a roller frame clip.
FIG. 5B is an elevated perspective view of the roller frame clip of FIG. 5A from a different angle.

FIG. 3 is a perspective view of tool cleaner 100 illustrating cleaning of a roller 140, in the form of a paint roller. As illustrated, the top cap assembly 104 has been rotated 180 degrees from the illustration of FIG. 2 while the cleaning operation provided by spray wand 112 is similar as set forth above. In this configuration, the roller cover 144 remains attached to roller frame 142 during cleaning. During operation, the liquid streams 114 output from spray wand 112 penetrate the paint holding material in roller cover 144 of roller 140. Likewise, the liquid streams 114 direct paint off from non-paint holding surfaces, such as a portion of roller frame 142 that is disposed inside canister 102. The resulting liquid-paint mixture then exists through the open bottom 103 of canister 102. Roller cover 144 is generally cylindrical and generally rotates within canister 102 with respect to roller frame 142. If the spray wand 112 directly faces roller cover 144, no rotation is produced. However, if the user manually rotates control knob 111 away from the center of roller cover 144, rotation thereof will be induced, thereby assisting in separation of paint from the roller. Unlike rotation of application tool 120, which is provided by rotation of tool holder assembly 122, roller cover 144 rotates with respect to a bearing within roller 140. The speed of rotation is generally proportional to the distance of the water streams from the center of roller cover 144. Accordingly, a faster rotation is produced and greater paint separation is achieved as the water streams are directed towards the edges of roller cover 144. Additional separation may be achieved as the user manually rotates the direction of the water streams against the direction of roller rotation by way of control knob 111. Roller 140 is held in place through contact between top cap assembly 104 and the top of canister 102. Roller frame 142 is further restrained from movement by way of roller frame clip 146. Accordingly, cleaning of roller 140 is provided without the necessity of the user holding onto roller 140 or roller handle 148.

FIG. 4 is an exploded perspective view of the top of canister 102 illustrating connection of spray wand assembly 106, handle assembly 108 and insertion of tool holder assembly 122 from top cap assembly 104. Canister 102 defines a top surface 150 and a peripheral recess 152 extending around front and side portions of top surface 150. A side surface 154 of peripheral recess 152 extends downwardly from top surface 150 and terminates in bottom ridge 156. In turn, bottom ridge 156 connects with the top of the outer side surface of canister 102. A pair of alternately disposed molded lugs 158 protrudes from the face of side surface 154. Molded protrusion 162 also extends from the side surface 154 and defines a molded channel 164 therein. Molded protrusion 162 and channel 164 releasably lock molded handle 166 into a closed position within peripheral recess 152. According to an alternate embodiment, a second molded protrusion and channel are formed in peripheral recess 152 opposite the first protrusion 164 and channel 164.

Handle assembly 108 is configured and arranged to be received within peripheral recess 152 about the top of canister 102. Handle assembly 108 includes molded handle 166 having a pair of integrally molded snap rivets 168. A roller frame clip 146 is slidably received about handle 166. Snap rivets 168 integrally protrude inwardly from handle 166 for connection into corresponding molded lugs 158, and respectively define axes of rotation for molded handle 166. The roller frame clip 146, described in greater detail below, is clipped onto handle 166. When handle 166 is in the closed position within peripheral recess 152, the roller frame clip 146 is held in place through engagement with handle 166. In particular, clip 146 engages a first plurality of bulbous protrusions 167 formed on the outside of handle 166. A second plurality of bulbous protrusions (not shown) is formed on the outside of handle 166 opposite from the first plurality to engage roller frame clip 146 when the roller 140 is inserted in a left-handed configuration.

The roller frame clip 146 is user adjusted along the range of bulbous oblong protrusions 167 on molded handle 166. In this embodiment, the protrusions 167 span approximately 2" along handle 166 to facilitate user optimization of roller frame position. It is known that roller frames are provided in a variety of forms that vary dimensionally. A roller frame that has a larger angled dimension from the roller cover will protrude a greater distance outwardly from the canister 102. In this case, by varying the position of the roller frame clip 146 along handle 166, a larger roller frame is accommodated. The user makes this adjustment to the roller frame clip 146 and then releases to allow the roller frame clip to be affixed in place. As noted above, a second set of oblong bulbous protrusions (not shown) are provided in a second position on the other side of handle 166 for user operation in a left-hand configuration.

The molded handle 166 further defines an interior ridge 172 that protrudes inwardly toward canister 102. When in the closed position, molded handle 166 rests within peripheral recess 152 and ridge 172 is snapped into channel 164 of molded protrusion 162. Handle 166 is rotatable into the open position about snap rivets 168 to facilitate carrying of tool cleaner 100 to a work location by the user. Handle 166 also allows the tool cleaner 100 to be hung on a wall as a method of storage.

Top canister opening 174 is defined in the top surface 150 of canister 102, and is configured and arranged to receive tool holder assembly 122 of top cap assembly 104. A curved frontal bead 176 protrudes upwardly from top surface 150 about a front portion and side portions of top canister opening 174. A frontal interior ridge 177 is defined within a frontal section of canister opening 174 to mate with a corresponding channel in top cap assembly 104. A curved rearward bead 178 protrudes upwardly from top surface 150 about a rear portion of opening 174. A rearward interior ridge 179 is defined within a rearward section of canister opening 174 to mate with a corresponding channel in top cap assembly 104. Frontal bead 176 and rearward bead 178 are configured to engage a peripheral edge of top cap assembly 104 (not shown) when installed.

As illustrated, frontal bead 176 and rearward bead 178 define a pair of passages for alternately receiving roller frame 142. The top surface 150 further defines first recess 180 and second recess 182, respectively, within each of the defined passages. First recess 180 receives a first flexible bottom section 181 and second recess 182 receives a second flexible bottom section 183. Bottom sections 181 and 183 are configured to flexibly deform when roller frame 142 is placed thereon. Roller frame 142 may be selectively held in at least one of two positions between top cap assembly 104 and top surface 150. In a right-hand configuration, illustrated in FIG. 3, roller frame 142 is held between top cap assembly 104 and top surface 150 by first flexible bottom section 181 (shown in FIG. 4) and first flexible top section 254 (shown in FIG. 8). The user may then direct spray wand 112 by manipulating control knob 111 with the right hand. In a left-hand configuration (not shown), the roller frame 142 is held between top cap assembly 104 and top surface 150 by second flexible bottom section 183 (shown in FIG. 4) and second flexible top section 256 (shown in FIG. 9). The user may then direct spray wand 112 by manipulating control knob 111 with the left hand.

In the absence of a roller frame, bottom sections 181 and 183 mate with corresponding sections 254, 256 (shown in FIG. 9) within top cap assembly 104 to thereby provide a liquid seal. Bottom sections 181 and 183 may be made from a material that is affixable to canister 102 within the respective furrow with a suitable adhesive. According to a preferred embodiment, bottom sections 181 and 183 are adhesive backed micro cellular polyurethane, wherein the mating is provided by an adhesive bond. According to the illustrated embodiment, the spacing between frontal bead 176 and rearward bead 178, above bottom sections 181, 183, is symmetrical. Differently sized and/or oriented roller frames are accommodated by tool cleaner 100 by repositioning roller frame clip 146 about handle assembly 108. According to an alternate embodiment, the spacing between frontal bead 176 and rearward bead 178, above bottom sections 181, 183, is not symmetrical to accommodate differently sized and/or differently oriented roller frames.

Spray wand opening 184 is defined in a rearward section of top surface 150 of canister 102, and is configured and arranged to receive spray wand 112 of spray wand assembly 106 therein. Peripheral bead 186 protrudes upwardly around spray wand opening 184. Peripheral bead 186 includes a pair of C-shaped projections 188 that extend peripherally toward the sides of canister 102. The C-shaped projections 188 are respectively received within side protrusions 190 of control knob 111. The C-shaped projections 188 limit free rotation of control knob 111 about peripheral bead 186. Accordingly, control knob 111 is confined to back and forth pivotal motion with respect to top cap assembly 104, and thereby facilitates user control of the water stream exiting from spray wand 112 toward the tool or roller disposed within canister 102.

FIGS. 5A and 5B are perspective views of roller frame clip 146. Roller frame clip 146 is slidably attached to handle 166 by way of integral C-shaped member 200. Extension blades 202 extend outwardly from the external side of C-shaped member 200 and are configured to engage roller frame 142 of roller 140. The exterior sides of extension blades 202 have a plurality of oblong protrusions 204 for gripping by the hand. The interior sides of extension blades 202 are preferably formed with a plurality of molded buttons 206 for releasably engaging opposite sides of roller frame 142. The extension blades 202 are angled outwards to engage a range of roller frames having varying diameters and axis angles. Likewise, molded buttons 206 are configured about the extension blades 202 to engage the range of roller frames. The C-shaped member 200 is formed through a pair of curved projections 208 that are configured to extend around handle 166. When clip 146 is engaged with handle 166, the opening between curved projections 208 permits flush engagement about the interior ridge 172 defined by handle 166. Preferably, roller frame clip 146 is clipped about the outside of handle 166. According to an embodiment of the present invention, the interior surface of C-shaped member 200 optionally defines a pair of protruding buttons 210 that engage alternate sides of oblong protrusions 167 in handle 166. According to an alternate embodiment, an optional vertical ridge 212 is provided on the interior surface of C-shaped member 200 to engage at least one of the oblong protrusions 167 in handle 166. Accordingly, roller frame clip 146 maintains its position about handle 166 when lateral pressure is exerted thereon by way of roller frame 142. As set forth above, roller frame clip 146 is movable about the oblong bulbous protrusions 167 in a variety of positions to accommodate roller frames of varying size.

Figures 6, 7, 8:
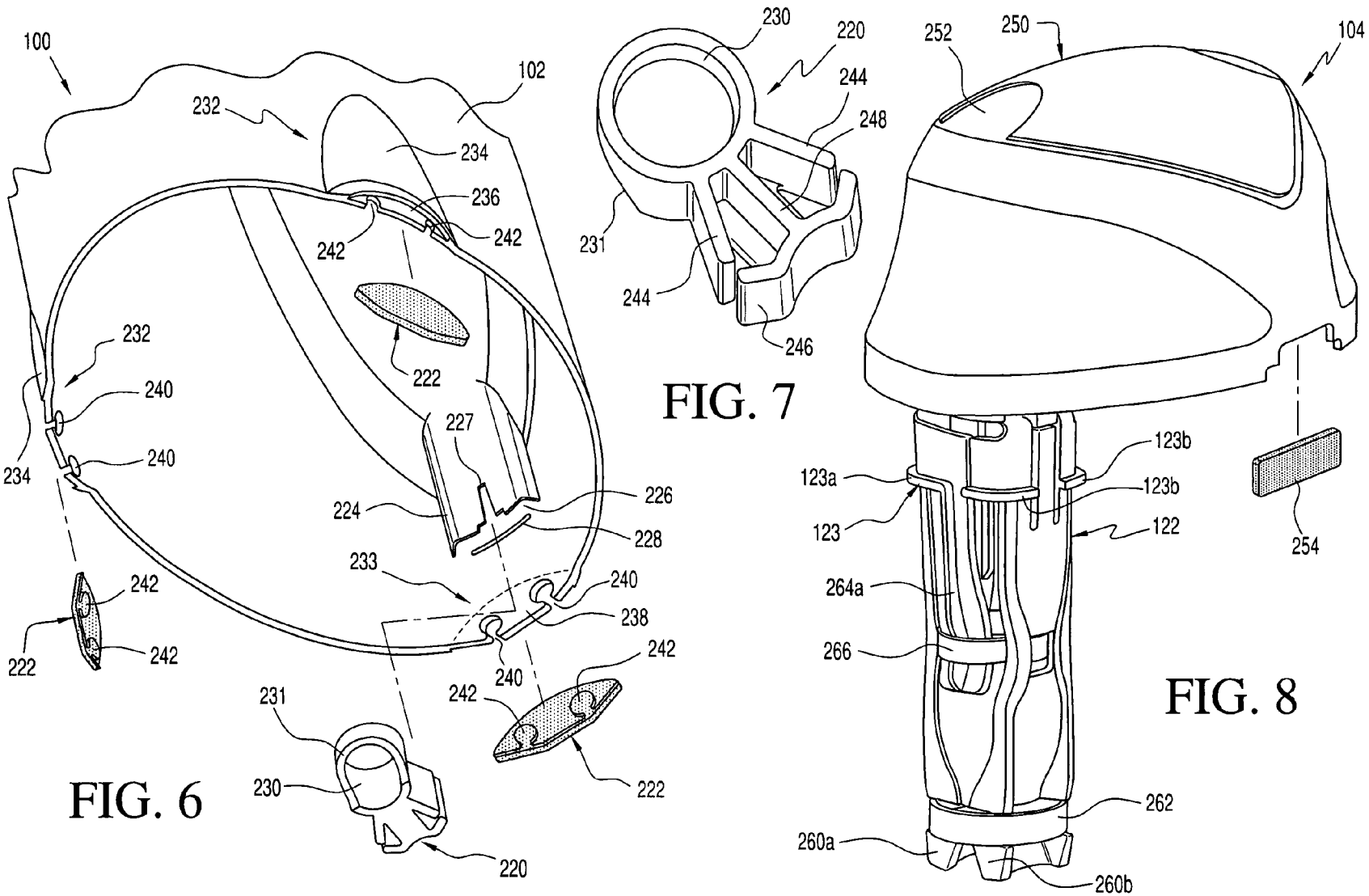
FIG. 6 is an exploded perspective view of the bottom of the tool cleaner of FIG. 1 illustrating placement of a wand retention clip and feet.
FIG. 7 is an elevated perspective view of a wand retention clip.
FIG. 8 is a perspective view of a top cap assembly of the tool cleaner of FIG. 1.

FIG. 6 is an exploded bottom view of tool cleaner 100 illustrating placement of a wand retention clip 220 and foot members 222 into canister 102. The interior of canister 102 includes molded protrusion 224 that abuts the interior wall of canister 102 thereby forming retention cavity 226. Wand retention clip 220, described in greater detail with respect to FIG. 7 below, is slidably received within retention cavity 226 and mates with retention channel 227 in protrusion 224. Wand retention clip 220 further defines cylindrical tube 230 for rotatably retaining spray wand 112 therein. Cylindrical tube 230 further defines recessed section 231 to allow liquid stream of bottom spray nozzle 125 (see FIG. 14) to clear clip 220. When frontal section 363 of spray wand 112 is crown shaped, the crown is rotatably retained within cylindrical tube 230. On the other hand, when frontal section 363 is flat, a curved protrusion 365 (see FIG. 14) extends therefrom such that the spray wand 112 is rotatably retained within cylindrical tube 230.

Foot members 222 are configured for connection with front foot supports 232 and rear foot support 233 in canister 102. Each of the front foot supports 232 define a corresponding parabolic bulb 234 that extends outwardly from canister 102. Each bulb 234 further defines a crescent indention 236 for receiving a corresponding crescent side of a foot support 232. Bulb 234 further defines a crescent extension 238, which has a pair of curved recesses 240 for receiving a corresponding pair of curved protrusions 242 that extend from a corresponding foot support 232. The rear foot support 233 does not have a bulb 234, but also defines a crescent extension 238 with a pair of curved recesses 240 for receiving a corresponding pair of curved protrusions 242 of foot support 232. According to a preferred embodiment, tool cleaner 100 has three foot supports as illustrated in FIG. 6. According to an alternate embodiment, tool cleaner 100 has four foot supports. According to yet another alternate embodiment, tool cleaner 100 has a pair of curved oblong foot supports that are disposed about the front and rear, or alternate sides of the bottom of canister 102.

For purposes of illustration, foot members 222 include curved protrusions 242 disposed on a side thereof. This forms a first embodiment of foot members 222. However, according to a preferred embodiment, curved protrusions 242 are disposed between a pair of symmetrical sidewalls. Each curved protrusion thereby forms an interior flexible tenon, and each curved recess 240, 242 thereby forms a mortise for forming a joint with a corresponding tenon.

FIG. 7 is a perspective view of wand retention clip 220 illustrated in FIG. 6. Wand retention clip 220 includes cylindrical tube 230 with a curved recessed section 231. Cylindrical tube 230 is connected to a pair of side extension arms 244 and T-shaped extension arm 246. A center connecting portion 248 of T-shaped extension arm 246 is received within retention channel 227 of molded protrusion 224 in the interior of canister 102. Side extension arms 244 abut the exterior surface of molded protrusion 224 to thereby rigidly hold wand retention clip 220 in place. The T-shaped extension arm 246 is locked within retention cavity 226 of molded protrusion 224 by way of retention ridge 228.

FIG. 8 is a perspective view of top cap assembly 104 upon being removed from top surface 150 of canister 102 about top canister opening 174. As set forth above, top cap assembly 104 may attach to the top of canister 102 in two positions rotated 180 degrees from each other. Top cap assembly 104 includes a cap housing 250 that is connected to tool holder assembly 122. Cap housing 250 is molded in a manner to accommodate the palm of the hand. Bearing cover 252 is integrally disposed within cap housing 250 and covers bearing components for free rotation of tool holder assembly 122. When top cap assembly 104 is installed onto the top of canister 102, a first flexible top section 254 mates with first flexible bottom section 181 in first recess 180 to seal the void between frontal bead 176 and rearward bead 178. Preferably, first top section 254 mates with first bottom section 181 by being disposed about an exterior lateral edge of bottom section 181. Alternatively, the bottom surface of first top section 254 mates with the top surface of first bottom section 181. When roller frame 142 (illustrated in FIG. 3) is disposed above first recess 180, first flexible top section 254 and first flexible bottom section 181 flexibly deform around roller frame 142 to form a seal. Likewise, a second flexible top section 256 (shown in FIG. 9) is disposed on the opposite side from first flexible top section 254 to thereby mate with second flexible bottom section 183 above second recess 182. Accordingly, a user of tool cleaner 100 may position a roller to be cleaned in either a right-hand configuration above first recess 180 or a left hand configuration above second recess 182. A primary purpose of the combination of the flexible top sections and the flexible bottom sections is to provide a liquid barrier. A secondary purpose is to provide additional support for roller frame 142 disposed therein.

Tool holder assembly 122 may also be used to rotatably support a roller cover that has been disengaged from a roller frame. Roller covers, by convention, have an interior diameter of approximately 1.5". Accordingly, the outside diameter of tool holder assembly 122 is configured to friction engage the interior of a roller cover. The roller cover is slidably received about tool holder assembly 122 until it engages roller stopping ridge 123. According to a preferred embodiment, roller stopping ridge 123 is formed from a plurality of ridge sections 123*a*, 123*b*, respectively formed in first and second large tool arms 260*a*, 260*b*.

Tool holder assembly 122 includes a first large tool arm 260*a* and a second large tool arm 260*b* that cooperate to hold a handled tool, such as a paint brush. Large tool arms 260*a*, 260*b* are urged toward a closed position by way of first elastic tension member 262. Tool holder assembly 122 also includes a first small tool arm 264*a* and a second small tool arm (not shown) that also cooperate to hold a handled tool, such as a paint brush. Preferably, the second small tool arm is symmetrical to first small tool arm 264*a*. The small tool arms are urged toward a closed position by way of second elastic tension member 266. According to an embodiment of the present invention, a tool held by tool holder assembly 122 is held by at least one pair of tool arms, such as the large tool arms or the small tool arms. According to a preferred embodiment, the large tool arms cooperate to hold a handled tool and the small tool arms also cooperate to hold the handled tool such that the handled tool is cooperatively engaged with two pairs of tool arms about two positions. This provides stabilization to resist tool wobble during spinning within canister 102. A second purpose of the plural tool arm pairs is to grip a range of different diameter tool handles. It is common for tool handles, such as paint brush handles, to have an irregularly shaped handle for ergonomical grasping with the human hand. Thus, many tool handles have different functional diameters along their length. According to a preferred embodiment, a handled tool is pushed all the way between the large tool arms and the small tool arms until the tool handle hits holder base 278 (described in greater detail below).

FIG. 9 is an exploded perspective view of the top cap 104 illustrated in FIG. 8. Cap housing 250 defines a first holder recess 270, a second holder recess 272, and a plurality of reinforcing ribs 273. As illustrated, first flexible top section 254 is received within first holder recess 270 and second flexible top section 256 is received within second holder recess 272. The sections 254 and 256 may be held in place with a compound such as glue or solvent.

Tool holder assembly 122 is formed from first holder member 274, second holder member 276 and holder base 278. As illustrated, first large tool arm 260*a* and first small tool arm 264*a* are molded continuously in first holder member 274. Likewise, second large tool arm 260*b* and a second small tool arm (not shown) are molded continuously in second holder member 276. According to the preferred embodiment, as illustrated, first holder member 274 and second holder member 276 are identical. Accordingly, the second small tool arm (not shown) is identical in form and molding to first small tool arm 264*a*. First holder member 274 and second holder member 276 are pivotally received within holder base 278, as described in greater detail below. Holder base 278 is attached to shaft 280 by way of mounting screw 282, toothed lock washer 284, and washer 286. Shaft 280 rotates continuously with holder base 278. Shaft 280 is received within the tubular recess 290 formed in cap housing 250. After passing through cap housing 250, shaft 280 passes through bottom bushing 292, top bushing 294, and washer 296 for connection to lock nut 298. Bearing cover 252 then mates with cap housing 250 to cover the internal components.

FIG. 10 is an exploded perspective view of tool holder assembly 122. First holder member 274 and second holder member 276 are pivotally received in holder base 278. In particular, second holder member 276 includes a pair of curved pivot arms 300*a*, 300*b* that are configured and arranged to be pivotally received around respectively corresponding pivot axes 302*a*, 302*b* in holder base 278. Likewise, first holder member 274 includes a pair of curved pivot arms 304*a*, 304*b* that are configured and arranged to be pivotally received around respectively corresponding pivot axis 306*a* and another pivot axis (not shown) in holder base 278. Holder base 278 is symmetrical, such that pivot axes 302*a*, 302*b* are identical to the oppositely disposed pivot axes (only pivot axis 306*a* is shown). First holder member 274 and second holder member 276 flex outwardly to hold a plurality of different tool handle sizes. The outward flexion of first and second holder members 274, 276 retard rotation of a handle held therein. First holder member 274 and second holder member 276 are urged toward each other by way of first elastic tension member 262 and second elastic tension member 266 as illustrated in FIG. 9.

Holder base 278 includes a curved catch section 303 disposed between pivot axes 302*a* and 302*b*. Another curved catch section (not shown) is disposed on the opposite side of holder base 278 between the oppositely disposed pivot axes (only pivot axis 306*a* is shown). With reference to holder base 278 and second holder member 276, curved catch section 303 has a curved top section that terminates in an angled bottom section 305. Curved catch section 303 is configured to interact with flexible stay 301 in second holder member 276. During attachment, second holder member 276 is first arranged to be orthogonal to holder base 278 so that curved pivot arms 300*a*, 300*b* respectively engage pivot axes 302*a*, 302*b*. As second holder member 276 is rotated downwardly into position, flexible stay 301 engages with the curved top section of curved catch section 303. As second holder member 276 continues to rotate, flexible stay 301 passes from the curved top section of curved catch section 303 to the angled bottom section 305, which thereby locks second holder member 276 to holder base 278. Once assembled, the interaction of first and second curved pivot arms 300*a*, 300*b* with pivot axes 302*a* and 302*b*, and the interaction of flexible stay 301 with respect to the angled bottom section 305 of catch section 303 retards a pivot motion of second holder member 276 with respect to holder base 278. A symmetrical attachment operation is performed to attach first holder member 274 to the opposite side of holder base 278.

First holder member 274 and second holder member 276 are urged toward each other by way of first elastic tension member 262 (see FIG. 9). First holder member 274 includes recessed arcuate section 268*a* and second holder member 276 includes recessed arcuate section 268*b* for receiving first elastic tension member 262 thereabout. Second holder member 276 includes retaining ribs 269*b* that are formed along the sides of second holder section 276. The retaining ribs 269*b* protrude outwardly from second holder section 276 and terminate at the sides of arcuate section 268*b* to thereby maintain first elastic tension member 262 within arcuate section 268*b*. Likewise, first holder member 274 includes retaining ribs 269*a* for maintaining first elastic tension member 262 along arcuate section 268*a* of first holder section 274. The combination of recessed arcuate sections 268*a*, 268*b* and retaining ribs 269*a*, 269*b* permit a roller cover that has been disengaged from a roller frame to be inserted around the outer periphery of first large tool arm 260*a* and second large tool arm 260*b* without interfering with the first elastic tension member 262.

First holder member 274 and second holder member 276 are also urged toward each other by way of second elastic tension member 266 (see FIG. 9). First small tool arm 264*a* includes recessed arcuate section 390*a* for receiving second elastic tension member 266 thereabout. Likewise, a second small tool arm (not shown), that is symmetrical to the first small tool arm 264*a*, includes a recessed arcuate section for receiving second elastic tension member 266 thereabout. The first small tool arm 264*a* has a rib 392*a* that extends longitudinally along an exterior surface. Arcuate section 390*a* is recessed with respect to rib 392*a* such that when a roller cover is removed from a roller frame and inserted around tool holder assembly 122, the roller cover will not interfere with second elastic tension member 266. As illustrated, rib 392*a* in first small tool arm 264*a* is integral with ridge section 123*a*. However, rib 392*a* does not interfere with placement of a roller cover about the outer periphery of tool holder assembly 122 due to inward flexion of first small tool arm 264*a*. Further, the first small tool arm 264*a* may be molded to be inwardly disposed from the outer periphery of tool holder assembly 122 as primarily defined by large tool arm 260*a*, 260*b*.

Second elastic tension member 266 is disposed respectively within arcuate sections of the small tool arms. In particular, second elastic tension member 266 is disposed within arcuate section 390*a* of small tool arm 264*a* and likewise disposed within an arcuate section in the other symmetrical small tool arm (not shown). However, second elastic tension member 266 is also attached to molded hooks 394*a*, 394*b* that are integral to and project inwardly from the respective large tool arms 260*a*, 260*b*. Thus, second elastic tension member 266 is disposed around the arcuate sections of the small tool arms and is inserted into hooks 394*a*, 394*b* so that a tool handle may freely pass into and out of tool holder assembly 122 without hitting the second elastic tension member 266.

Large tool arms 260*a*, 260*b* respectively include rib sections on inner faces thereof. Large tool arm 260*a* is illustrated with rib section 380*a*, with the rib section (not shown) in large tool arm 260*b* being symmetrical. Each rib section includes a plurality of vertically extending ribs that guide the handle of a tool during vertical insertion between tool arms 260*a*, 260*b*. The ribs preferably form a V shape such that the center of the V forms a pocket for receiving the tool handle. Likewise, the vertically extending ribs help to maintain an irregularly shaped tool handle in a state of vertical repose between holder sections 274, 276. According to an embodiment, the small tool arms may optionally include a plurality of vertically extending ribs (not shown) along an inner surface thereof.

Holder base 278 includes a plurality of angled fingers 396 extending downwardly therefrom about central shaft hole 400. The mounting screw 282 and threaded lock washer 284 are disposed within central shaft hole 400 and are thereby recessed with respect to angled fingers 396. A tool handle is intended to be inserted completely between large tool arms 260*a*, 260*b* and the small tool arms until connecting to holder base 278. Angled fingers 396 then urge the tool handle toward the center thereof to maintain a vertical orientation of the tool during rotation. Central shaft hole 400 further provides stabilization for an end of an inserted handle tool.

Figure 11:
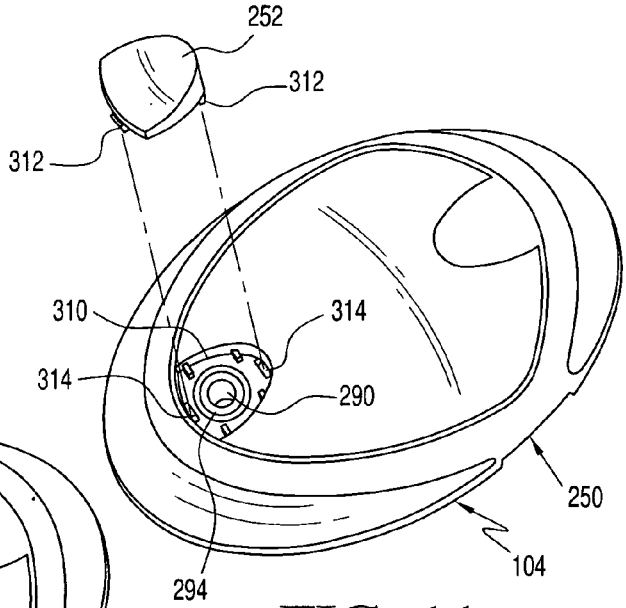
FIG. 11 is an exploded perspective view the top cap assembly of FIG. 8 illustrating placement of a shaft cover for the tool holder assembly.

FIG. 11 is an exploded top view of top cap assembly 104 and bearing cover 252. As illustrated, bearing cover 252 is configured and arranged to be received within bearing cover recess 310 defined in cap housing 250. Bearing cover 252 includes a plurality of snap fittings 312 that are configured to be received within snap fitting slots 314 in cap housing 250. For clarity, cap housing 250 is shown without shaft 280, washer 296 or lock nut 298. Top bushing 294 is illustrated after being press fit into the top of tubular recess 290. After insertion, bearing cover 252 is nearly flush with the surface of cap housing 250.

Figure 12:
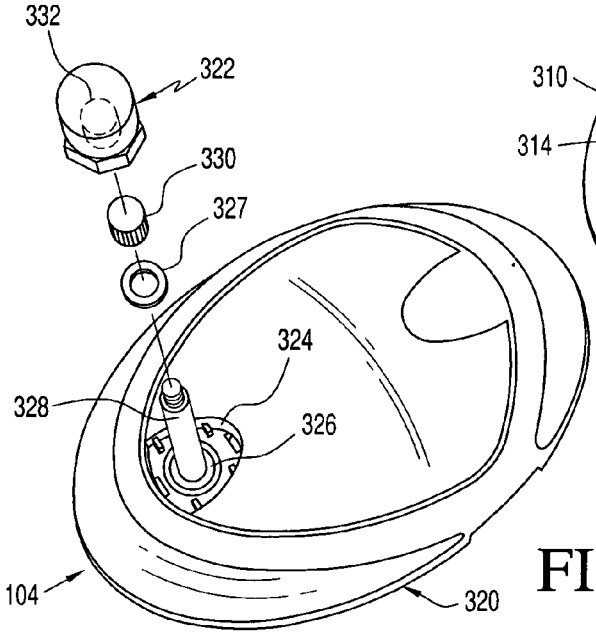
FIG. 12 is an exploded perspective view of the top cap assembly of FIG. 8 according to an alternate embodiment showing a rotator knob.

FIG. 12 is an exploded top view of an alternate embodiment of top cap assembly 104. As illustrated, top cap assembly 104 includes cap housing 320 in which the bearing cover has been replaced by rotator knob 322. Bearing cover recess 324 is provided for installation of a bottom bushing (not shown) similar to bottom bushing 292 of FIG. 9, a top bushing 326, and a washer 327. In this case, shaft 328 extends upwardly through bearing cover recess 324. A fluted lock nut 330 is then screwed onto the top of shaft 328. Rotator knob 322 includes a fluted inner lug 332 that is friction fit onto fluted lock nut 330. The distal end of shaft 328 (not shown) connects to tool holder assembly 122 in a manner shown in FIG. 9. Accordingly, as rotation of tool holder assembly 122 is induced by way of water streams 114 exiting from spray wand 122, rotator knob 322 also rotates. Rotator knob 322 also allows the user to manually initiate rotation of tool holder assembly 122 by manual turning thereof. Alternately, the user may manually prohibit free rotation of rotator knob 322, or turn rotator knob in an opposite direction than would be induced by the water streams 114 to promote cleaning of a handled application tool within canister 102.

Figures 13, 14, 15, 16:
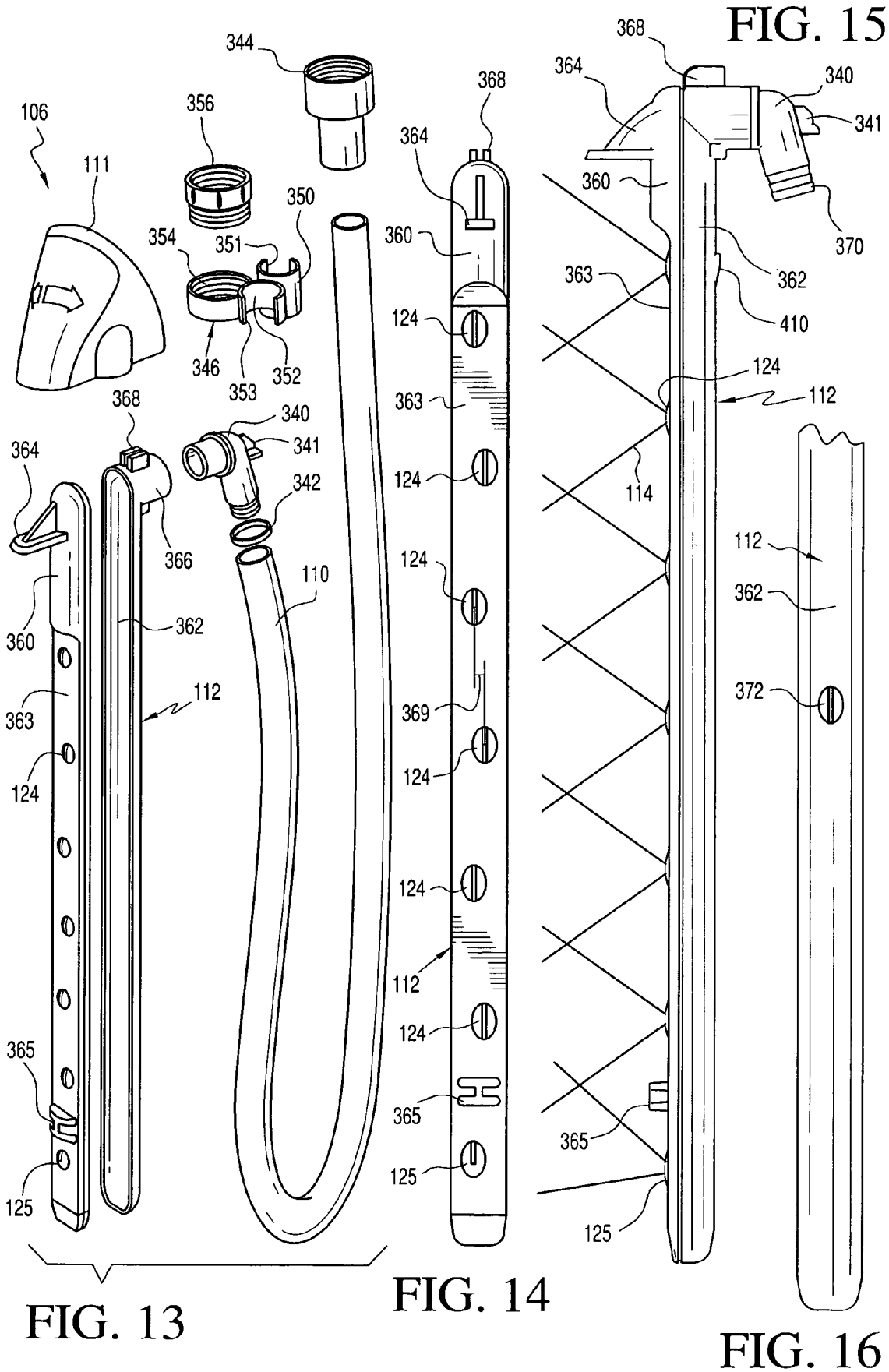
FIG. 13 is an exploded perspective view of a spray wand assembly.
FIG. 14 is a front view of the spray wand illustrated in FIG. 13.
FIG. 15 is a side view of the spray wand illustrated in FIG. 13 during a spraying operation.
FIG. 16 is a rear view of the spray wand illustrated in FIG. 13 showing placement of an optional cleaning jet.

FIG. 13 is an exploded perspective view of spray wand assembly 106. As illustrated, the spray wand assembly 106 includes spray wand 112 that is connected to supply hose 110 by way of elbow joint 340 and hose clamp 342. The hose clamp 342 crimps the proximal end of supply hose 110 onto ridged section 370 of elbow joint 340 to thereby provide a permanent attachment. Supply hose 110 terminates at the distal end in threaded coupling 344 for connection to a water supply, such as an outdoor water faucet. Hose retention clip 346 includes a first curved attachment member 350 that is configured by way of an associated opening 351 to engage the body of supply hose 110. A second curved attachment member 352 is also included in hose retention clip 346. Second curved attachment member 352 has an associated opening 353 for attachment to supply hose 110 during storage. The opening 353 in curved member 352 is preferably larger than opening 351 in curved member 350 such that it is more easily removed from supply hose 110. Hose retention clip 346 also includes a threaded retaining sleeve 354 for storing threaded fitting 356. The threaded fitting 356 may be used to connect threaded coupling 344 to a water supply having a different size than an outdoor water faucet, such as an indoor household water faucet.

Spray wand 112 is formed from first matable section 360 and second matable section 362. The first matable section 360 faces the interior cavity of canister 102 and defines a frontal section 363 including a plurality of apertures 124. Frontal section 363 may be crown shaped or flat. According to a preferred embodiment, frontal section 363 is flat. First matable section 360 includes a front extension prong 364 that protrudes laterally from the top side thereof. Likewise, second matable section 362 includes a rear extension prong 341 that protrudes laterally from the top side thereof. Front extension prong 364, rear extension prong 341, and top connection prongs 368 are configured to engage corresponding internal sections of control knob 111. The front extension prong 364 limits free rotation of spray wand 112 through contact with C-shaped projections 188 of canister 102 (see FIG. 4). Second matable section 362 includes a tubular extension section 366 for connection to elbow joint 340. Connection prongs 368 extend upwardly from a top surface of tubular extension section 366 for connection to a corresponding rib section in control knob 111. First matable section 360 also includes curved protrusion 365 that is configured and arranged to rotatably fit within cylindrical tube 230 of wand retention clip 220. Curved protrusion 365 preferably has an H shape. According to a preferred embodiment, spray wand 112 has apertures 124 that are fan jets, described in greater detail below. Preferably, lower aperture 125 is a fan jet that does not spray downwardly to the extent of apertures 124 to thereby increase efficiency of water flow within canister 102. First matable section 360, second matable section 362, and elbow joint 340 are preferably permanently sealed to each other using known techniques, such as glue, solvent or sonic bonding.

FIG. 14 is a front view of spray wand 112 illustrating a plurality of staggered apertures 124 within frontal section 363 of first matable section 360. Apertures 124 are staggered with respect to a center line of frontal section 363 such that at least one of the apertures 124 are on a first side of the center line and at least one of the apertures 124 are on the center line or on a second side of the center line. As illustrated, connecting prongs 368 extend upwardly from the top of spray wand 112. Likewise, front extension prong 364 extends outwardly from the top of spray wand 112.

According to a preferred embodiment, apertures 124 are fan jets that provide a liquid stream that is relatively narrow in a direction perpendicular to spray wand 112. Preferably, the liquid stream output from fan jet 124 is more narrow than the diameter of spray wand 112. Preferably, the liquid stream output from fan jet 124 fans upwardly and downwardly from fan jet 124 commensurate with the longitudinal axis of spray wand 112. The angle of the liquid stream output from fan jet 124 is greater in the longitudinal direction than in the perpendicular direction with respect to spray wand 112. According to a preferred embodiment, fan jets 124 have openings approximately 3.5 mm×0.85 mm. These dimensions provide a preferred embodiment of the present invention. Dimensions could vary by as much as 10%-20% within the scope of a preferable embodiment. Apertures 124 are approximately 45 mm apart, with a horizontal offset 369 of 4 mm between adjacent apertures 124. In other words, the horizontal distance between the centers of apertures 124 is 4 mm. This is so that the liquid stream fans 114 output from apertures 124 overlap but do not interfere with one another near the wand. Preferably, there are seven apertures that are set 45 mm apart. Preferably, the top six apertures 124 are identical with bottom aperture 125 limited to spraying upwardly, as described in greater detail below. According to alternate embodiments, the spray wand 112 could be produced with fewer or more apertures, with different spacing, and nozzle geometry.

FIG. 15 is a side view of spray wand 112 illustrating liquid streams 114 exiting therefrom. As illustrated, elbow joint 340 includes a ridged section 370 that friction engages supply hose 110. Hose clamp 342 (shown in FIG. 13) binds hose 110 to ridged section 370. First matable section 360 also includes curved protrusion 365 that is configured and arranged to rotatably fit within wand retention clip 220. As illustrated, liquid streams 114 exiting from apertures 124 intersect as set forth in greater detail below.

Spray wand assembly 106 is preferably snap-fit within peripheral bead 186 on the top surface 150 of canister 102. Control knob 111 is preferably snap fit onto front extension prong 364 and rear extension prong 341 prior to distribution to the end user. Connection prongs 368 register and provide stability for connection to a corresponding recess in control knob 111. However, the user will preferably install spray wand assembly 106 (see FIG. 13) by inserting spray wand 112 into peripheral bead 186. Upon insertion, retention bead 410 catches the underside (not shown) of the top surface of 150 of canister 102.

FIG. 16 is a rear view of spray wand 112 according to an alternate embodiment. As illustrated, second matable section 362 includes an option cleaning jet 380. The cleaning jet 380 has similar dimensions to the apertures 124 set forth above. In general, cleaning jet 380 is situated near the top of spray wand 112, facing in the opposite direction from apertures 124. Accordingly, cleaning jet 380 sprays a liquid water fan stream at the inside of the back surface of canister 102 to keep it clean.

Figure 17A:
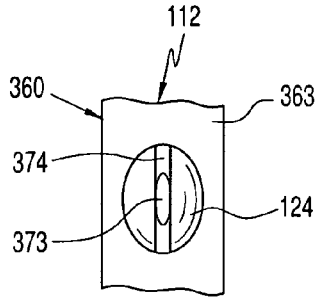
FIG. 17A is a detailed front view of a fan jet.
Figure 17B:
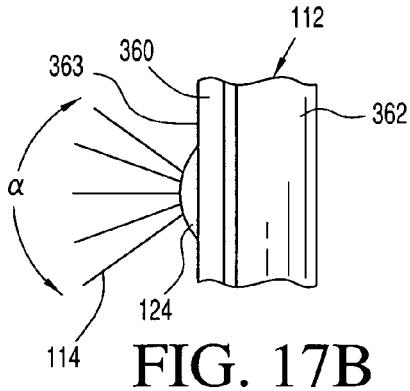
FIG. 17B is a detailed side view of the fan jet of FIG. 17A during a liquid jetting operation.
Figure 17C:
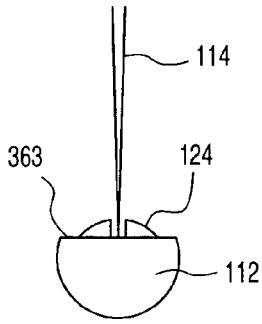
FIG. 17C is a top view of the fan jet of FIG. 17A during a liquid jetting operation.

FIGS. 17A, 17B, and 17C are respective front, side and top views of aperture 124 in the form of a fan jet. Fan jet 124 is preferably formed as an oblong bulbous protrusion from the frontal section 363 of first matable section 360. Fan jet 124 has a vertical channel 374, in combination with the lentil shaped orifice 373 from which the fan-shaped liquid stream 114 is produced. Channel 374 is approximately 3.5 mm×0.85 mm. These dimensions could vary by as much as 10%-20%. Fan jet 124 produces a fan jet stream 114 that has an included angle $\alpha$ between 65° to 90°. According to a more preferred embodiment, the angle $\alpha$ is between 68° to 80°. A preferred included angle $\alpha$ of fan jet stream 114 is 73°.

Figure 18A:
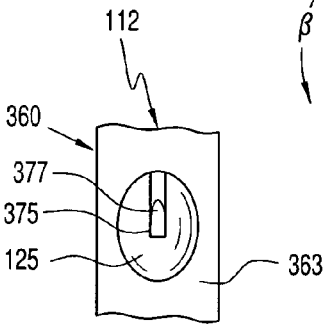
FIG. 18A is a detailed front view of a bottom jet.
Figure 18B:
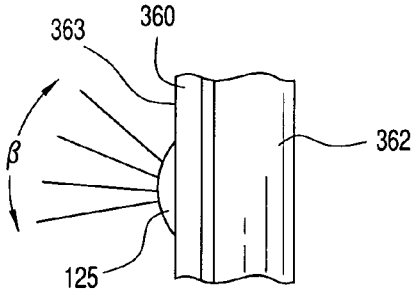
FIG. 18B is a detailed side view of the bottom jet of FIG. 18A during a liquid jetting operation.

FIGS. 18A and 18B are respective front and side views of bottom aperture 125 having an associated vertical channel 375 in combination with half lentil shaped orifice 377. The vertical channel 375 of bottom aperture 125 preferably has a narrower included angle $\beta$ for the associated jet stream than angle $\alpha$ of fan jet 124. Bottom aperture 125 is directed upwards to prevent water from being sprayed out of the bottom of canister 102. Bottom aperture 125 has an included angle $\beta$ between 45° to 65°. According to a more preferred embodiment, bottom aperture 125 produces an angle $\beta$ between 50° to 60°. A preferred included angle $\beta$ for the associated stream from bottom aperture 125 is 55°.

Figure 19:
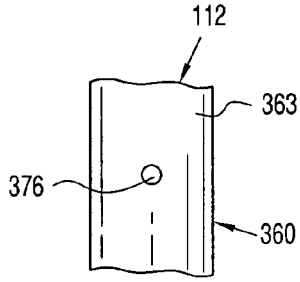
FIG. 19 is a front view of an optional needle jet according to an alternate embodiment of the present invention.

FIG. 19 is a front view of a needle jet 376 according to an alternate embodiment of the present invention. According to a first alternate embodiment, the plurality of apertures 124 illustrated in FIG. 2 is replaced by a plurality of optional needle jets 376. Needle jets 376 generally produce a narrow needle-like liquid stream that does not fan in a particular direction. Needle jets 376 concentrate the pressurized water from hose 112 through a smaller opening compared to the fan jets 124, and accordingly output liquid therefrom at a greater speed. Accordingly, needle jets 376 generally produce a greater depth of penetration into paint holding materials, such as bristles 128 of brush 120. According to yet another alternate embodiment, spray wand 112 may include a plurality of fan jets 124 and a plurality of needle jets 376. A preferable form for this embodiment includes five fan jets 124, two needle jets 376, and one bottom jet 125. During rotation, needle jets 376 continue to produce a greater depth of penetration into paint holding materials of tool 120 than fan jets 124.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

We claim:

1. A tool cleaner comprising:

a hollow canister having a top surface;

a spray wand assembly having a spray wand with a plurality of apertures, the spray wand being rotatably disposed within the canister and being connectable to a pressurized liquid source;

a top cap assembly including a tool holder assembly and configured to mate with the top surface of the canister in at least two alternate positions including:

a first position wherein the tool holder assembly is disposed within the canister away from the spray wand assembly such that a roller frame may be secured to the canister and disposed between the tool holder assembly and the spray wand assembly, and a second position wherein the tool holder assembly is disposed within the canister near the spray wand assembly such that a handled application tool may be secured to the tool holder assembly; and an interior ridge disposed within the hollow canister that resists mating of the top cap assembly with the hollow canister in the first position when the tool holder assembly is holding a tool.

2. The tool cleaner of claim 1, wherein the second position of the top cap assembly is alternatively capable of securing a roller cover.

3. The tool cleaner of claim 2, wherein the tool holder assembly is freely rotatable, the tool holder assembly having an outer geometry that is capable of securing the roller cover.

4. The tool cleaner of claim 2, wherein the tool holder assembly is freely rotatable, the tool holder assembly having a pair of tool holding sections that are elastically biased towards one another, the tool holding sections being capable of holding the handled application tool.

5. The tool cleaner of claim 1, wherein one of the top cap assembly or the top surface of the canister includes at least a first recess or a first furrow, respectively, for securing the roller frame.

6. The tool cleaner of claim 5, wherein said one includes at least a second recess or a second furrow, respectively, for securing the roller frame.

7. The tool cleaner of claim 5, further including a roller frame clip for securing the roller frame.

8. The tool cleaner of claim 7, further including a handle rotatably attached to a top section of the canister and supporting the roller frame clip, wherein the roller frame clip is selectably positionable about said handle to secure a plurality of different sized roller frames.

9. The tool cleaner of claim 1, wherein the apertures of the spray wand are staggered with respect to a center line of the spray wand.

10. The tool cleaner of claim 9, wherein the apertures of the spray wand include at least one of a fan jet and a needle jet.

11. The tool cleaner of claim 10, wherein a bottom aperture of the apertures of the spray wand primarily sprays water in an upward direction.

12. The tool cleaner of claim 1, further including foot members secured to the bottom of the canister to raise the bottom of the canister off a supporting surface to thereby allow liquid egress from the canister.

13. The tool cleaner of claim 1, further comprising:

a spray wand control knob attached to a top section of the spray wand in a position above the top surface of said canister, wherein the spray wand control knob may pivot under control of an operator to thereby direct pressurized liquid streams from the plurality of apertures towards a secured handle application tool or a roller cover attached to a secured roller frame.

14. A tool cleaner comprising:

a hollow canister defining a top opening and an open bottom, a spray wand assembly having a spray wand with a plurality of apertures, the spray wand being rotatably disposed within the canister and being connectable to a pressurized liquid source, a top cap assembly configured to mate with the top opening of said canister, said top cap assembly having a freely rotatable tool holder assembly to rotatably retain a handled application tool; and an interior ridge disposed within the hollow canister that resists mating of the top cap assembly with the hollow canister in a first position when the tool holder assembly is holding a tool.

15. The tool cleaner according to claim 14, wherein the tool holder assembly has a pair of tool holding sections that are pivotally urged toward each other, and each of the tool holding sections has a first tool holding arm such that the pair of first tool holding arms cooperate to retain the handled application tool.

16. The tool cleaner according to claim 15, further comprising a first elastic tension member disposed about an outer periphery of each of the first tool holding arms.

17. The tool cleaner according to claim 15, wherein each of the tool holding sections has a second tool holding arm such that the pair of second tool holding arms cooperate to retain the handled application tool.

18. The tool cleaner according to claim 17, wherein the second tool holding arms are urged toward each other with a second elastic tension member disposed about an outer periphery of each of the second tool holding arms.

19. The tool cleaner according to claim 14, wherein the tool holder assembly has an outer geometry that is configured and arranged to retain a roller cover.

20. The tool cleaner according to claim 14, said spray wand assembly further comprising:

a spray wand control knob attached to a top section of the spray wand in a position above a top surface of said canister, wherein the spray wand control knob may pivot under control of an operator to thereby direct pressurized liquid streams from the plurality of apertures towards the handled application tool held by the tool holder assembly.

21. The tool cleaner according to claim 14, wherein the apertures are staggered with respect to a center line of a frontal section of the spray wand.

22. The tool cleaner according to claim 14, wherein at least one of the apertures is a fan jet that outputs a liquid stream fanning in the longitudinal direction with respect to the spray wand with a greater dispersion angle than in the perpendicular direction with respect to the spray wand.

23. The tool cleaner according to claim 14, wherein said top cap assembly is configured to mate with the top opening of said canister to hold a roller in at least a first position within said canister.

24. The tool cleaner according to claim 23, wherein said top cap assembly mates with the top opening of said canister to hold the roller in at least the first position or a second position within said canister.

25. The tool cleaner according to claim 14, wherein the top cap assembly mates with the top surface of the canister in at least one of two positions including a first position wherein the top cap is capable of securing a roller frame to the hollow canister and a second position wherein the top cap is capable of securing the handled application tool.

26. The tool cleaner according to claim 14, the tool holder assembly further comprising:

a shaft rotatably connected to and extending through a top cap of said top cap assembly, and a rotator knob positioned above the top cap and connected to the shaft such that the rotator knob controls rotation of the tool holder assembly.

27. A tool cleaner, comprising:

a hollow canister for housing a tool to be cleaned, said hollow canister defining a top opening, a spray wand assembly having a spray wand with a plurality of apertures, the spray wand being disposed within said hollow canister, and said spray wand assembly being connectable to a pressurized liquid supply such that liquid from the supply is transmitted through said assembly and out from the plurality of apertures, a top cap assembly including a tool holder assembly to retain a handled application tool and configured to mate with the top opening of said canister in at least two alternate positions including:

a first position wherein the tool holder assembly is disposed adjacent to a wall of the canister, and a second position wherein the tool holder assembly is disposed substantially near the center of the canister, and an interior ridge disposed within the hollow canister that resists mating of the top cap assembly with the hollow canister in the first position when the tool holder assembly is holding a tool.

28. The tool cleaner according to claim 27, wherein said a tool holder assembly rotatably retains the handled application tool.

29. The tool cleaner according to claim 28, wherein the top cap assembly is configured to resiliently retain a roller in at least first or second positions within said canister.

30. The tool cleaner according to claim 29, further comprising:

a handle assembly rotatably attached to a top section of said canister, said handle assembly including a handle supporting a movable roller frame clip, wherein when the roller is held by said top cap assembly and said canister, a roller frame of the roller is restrained from lateral movement by the roller frame clip, wherein the roller frame clip is movable to a plurality of positions along the handle.

31. The tool cleaner according to claim 27, wherein said tool holder assembly comprises:

an outer geometry that is configured and arranged to retain a roller cover.

32. The tool cleaner according to claim 27, wherein at least one of the apertures is a fan jet that outputs a liquid stream fanning in the longitudinal direction with respect to the spray wand with a greater dispersion angle than in the perpendicular direction with respect to the spray wand.

33. The tool cleaner according to claim 27, wherein said tool holder assembly comprises:

a pair of tool holding sections that are pivotally urged toward each other with a first elastic tension member.

34. The tool cleaner according to claim 33, wherein the pair of tool holding sections are pivotally urged toward each other with a second elastic tension member.

35. The tool cleaner according to claim 33, wherein each of the tool holding sections has a first tool holding arm and a second tool holding arm that cooperate to retain a handled application tool.

36. The tool cleaner according to claim 27, wherein the top cap assembly is configured to hold a roller in at least a first or a second position within said canister.

* * * * *